US005886272A

United States Patent [19]

Regenberg

[11] Patent Number: 5,886,272

[45] Date of Patent: Mar. 23, 1999

[54] GUITAR WITH CAPTIVE NECK JOINT

[75] Inventor: David C. Regenberg, Madison, Wis.

[73] Assignee: M-Tec Corporation, Middleton, Wis.

[21] Appl. No.: 761,645

[22] Filed: Dec. 6, 1996

[51] Int. Cl.[6] ..... G10D 3/00

[52] U.S. Cl. ..... 84/293; 811/291

[58] Field of Search ..... 84/267, 290, 291, 84/293

[56] References Cited

U.S. PATENT DOCUMENTS

| | | | |
|---|---|---|---|
| 3,424,048 | 1/1969 | Mack et al. | 84/290 |
| 3,550,496 | 12/1970 | Fender | 84/293 |
| 3,771,408 | 11/1973 | Wright | 84/291 |
| 4,027,570 | 6/1977 | Rendell et al. | 84/293 |
| 4,320,684 | 3/1982 | Podunavac | 84/291 |
| 4,432,267 | 2/1984 | Feller | 84/293 |
| 4,741,238 | 5/1988 | Carriveau | 84/291 |
| 4,793,236 | 12/1988 | McGuire et al. | 84/293 |
| 4,905,563 | 3/1990 | Davies | 84/291 |
| 4,982,640 | 1/1991 | Buscarino | 84/293 |
| 5,125,311 | 6/1992 | Boulanger et al. | 84/291 |
| 5,452,637 | 9/1995 | DeCola | 84/291 |

*Primary Examiner*—William M. Shoop, Jr.
*Assistant Examiner*—Jeffrey W. Donels
*Attorney, Agent, or Firm*—Lathrop & Clark LLP

[57] ABSTRACT

A guitar neck is formed with a protruding trapezoidal heel which extends into a pocket formed at the neck end of the body. Motion of the heel within the pocket is limited by the sides of the pocket, and by a lip which protrudes from the pocket floor to engage with the neck upwardly of the neck heel.

15 Claims, 3 Drawing Sheets

GUITAR WITH CAPTIVE NECK JOINT

FIELD OF THE INVENTION

The present invention relates to guitars in general, and to solid body electric guitars in particular.

BACKGROUND OF THE INVENTION

Construction of musical instruments has for millennia presented a challenge to the world's artisans. Many competing requirements of a fine instrument must be balanced by the craftsman. Paramount is the maintenance of the proper pitch relationships of the notes sounded. In addition the instrument should permit accurate manipulation to give the musical performer the creative response desired. Secondary requirements from a musical standpoint, but of keen interest from an economic standpoint, are the appearance and cost of the instrument.

Guitars of one sort or another have been played since at least the sixteenth century. Early guitars were of hollow body construction. The hollow body provided resonance and acoustical amplification to the plucked strings. So long as the guitar was played in chamber groups and before small audiences, the natural sounding of the hollow body acoustic guitar was of sufficient volume. With the increasing use of the guitar as an accompanying and lead instrument in twentieth century popular music, great strides were made in producing instruments which could carry to a larger audience, and which could be heard within a multi-piece band. The development of an acoustic guitar with great volume culminated with the large guitars of the 1930's, for example the Martin D-28 and the Gibson archtop Super 400.

Changing musical styles and performance venues, however, placed demands in terms of volume which even the most advanced acoustical designs could not satisfy. Popular performers required instruments which could penetrate the high ambient noise of a honkytonk or crowded dance hall. Many pioneer guitar designers worked to address the problem by providing electric amplification to the vibration of the guitar strings. Adolph Rickenbacker produced a prototype electric guitar in 1931. Known as the "Frying Pan," this elemental electric guitar consisted of a wooden neck connected to a minimal solid body. This guitar employed a simple transducer or pickup comprised of two horseshoe magnets enclosing a coil beneath the strings. In a guitar pickup, vibrations of the metal guitar strings induce a current in the coil, which is then conveyed by a cord or cable to a separate amplifier.

By providing artificial amplification to the vibrations of the strings, the shape of the guitar body was freed from the restrictions imposed by acoustic design considerations. An extreme example of this was the prototype solid body electric guitar designed by Les Paul in 1939–1941 known as "The Log." This guitar connected a wooden guitar neck to a rectangular block of wood with pickups mounted on it. The traditional S-curved sides of an acoustic guitar were merely screwed onto the central block—serving only an ornamental purpose.

Further developments in solid body guitar construction included the Fender Broadcaster and Telecaster of 1950–1951, and the Fender Stratocaster of 1954. Both body styles became extremely popular, and variations of these instruments, as well as accurate replicas, are still manufactured and played today.

Solid body guitar construction, although requiring less demanding constructions techniques than the thin wood bending required for acoustic guitars, is nonetheless an exacting process. Guitar performers desire an instrument that will stay "in tune" through protracted performances, that will be responsive to minute variations in performance technique, and that will yield a satisfying and rich sound. The timbre or "tone" of the guitar is of almost mystical concern to guitar players and afficionados, and each guitar manufacturer takes exquisite care to address this concern. While the independent guitar maker may painstakingly custom craft each instrument to achieve the desired results, the quantity manufacturer of guitars must, in order to keep costs at a reasonable level, work from a design which is repeatable and consistent.

One source of degradation in the integrity of the structure of the solid body guitar is the joint between the guitar neck and the body. To make adjustment of the string height and other neck characteristics possible, the neck is usually provided as a separate element from the body. Movement of the neck with respect to the body is highly undesirable, as such movement will affect the pitch and intonation of the strings as well as the feel and playability of the instrument. Typically, the neck has a protruding planar surface which slides into position on a mating planar surface on the body and is connected by screws. In body styles with a deep cutaway on one side of the neck to allow access to the higher ranges of the instrument, the neck can pivot or shift with respect to the body. This motion of the neck causes the instrument to go out of tune, can shift the strings off of the neck making the instrument unplayable, and causes creaking noises and further deteriorates the integrity of the neck joint. Through-neck guitar construction, such as that found in the Bigsby-Travis guitar of the 1940's, in which the neck continues through the body, alleviates this pivoting, but makes repair and neck adjustment more difficult. The neck may also be connected by a dovetail type joint to the body, and then glued in place. This presents the same drawbacks as through-neck construction. Another approach seen on guitars manufactured by Valley Arts Guitars of California, a company owned by Samick Corp., involves fixing a metal bracket to the bottom face of the neck at the neck joint, positioning a mating bracket in the pocket of the body at the neck joint and clamping the two brackets together. This feature is sold under the trademark INTERLOCK®. Yet another approach has been to form a rectangular protrusion on the neck which engages within a rectangular pocket recessed within the body. Yet the manufacture of such an assembly to the necessary close tolerances requires wood shaping techniques within a recessed pocket.

What is needed is a guitar of economical construction with structural features which preserve the position of the neck with respect to the body to provide an instrument of improved stability and tone.

SUMMARY OF THE INVENTION

The solid body electric guitar of this invention has improved stability of the neck with respect to the body. The wooden guitar neck is formed with a protruding trapezoidal heel which extends into a pocket formed at the neck end of the wooden body. Motion of the heel within the pocket is limit by the sides of the pocket, and by an upstanding lip which protrudes from the pocket floor to engage with the neck upwardly of the neck heel. This lip-heel engagement serves to prevent shifting of the neck with respect to the body from side to side as well as in the direction of the neck axis without relying on mechanical fasteners. Screws extend between the neck and the body to prevent separation or lifting apart of the neck from the body. For repair or adjustment, the screws are removed and the neck is lifted upwardly away from the body.

It is an object of the present invention to provide a solid body electric guitar with a neck which does not shift with respect to the body during ordinary play, but in which the neck may be easily removed for repair or adjustment.

It is an additional object of the present invention to provide a solid body electric guitar which is of sturdy construction yet which is easily disassembled.

It is another object of the present invention to provide a solid body electric guitar with good playability and reduced tendencies to fall out of tune.

It is an additional object of the present invention to provide a guitar with a body neck joint which is easily manufactured to exacting tolerances on an individual basis.

Further objects, features and advantages of the invention will be apparent from the following detailed description when taken in conjunction with the accompanying drawings.

DESCRIPTION OF THE PREFERRED EMBODIMENT

Figure 1:
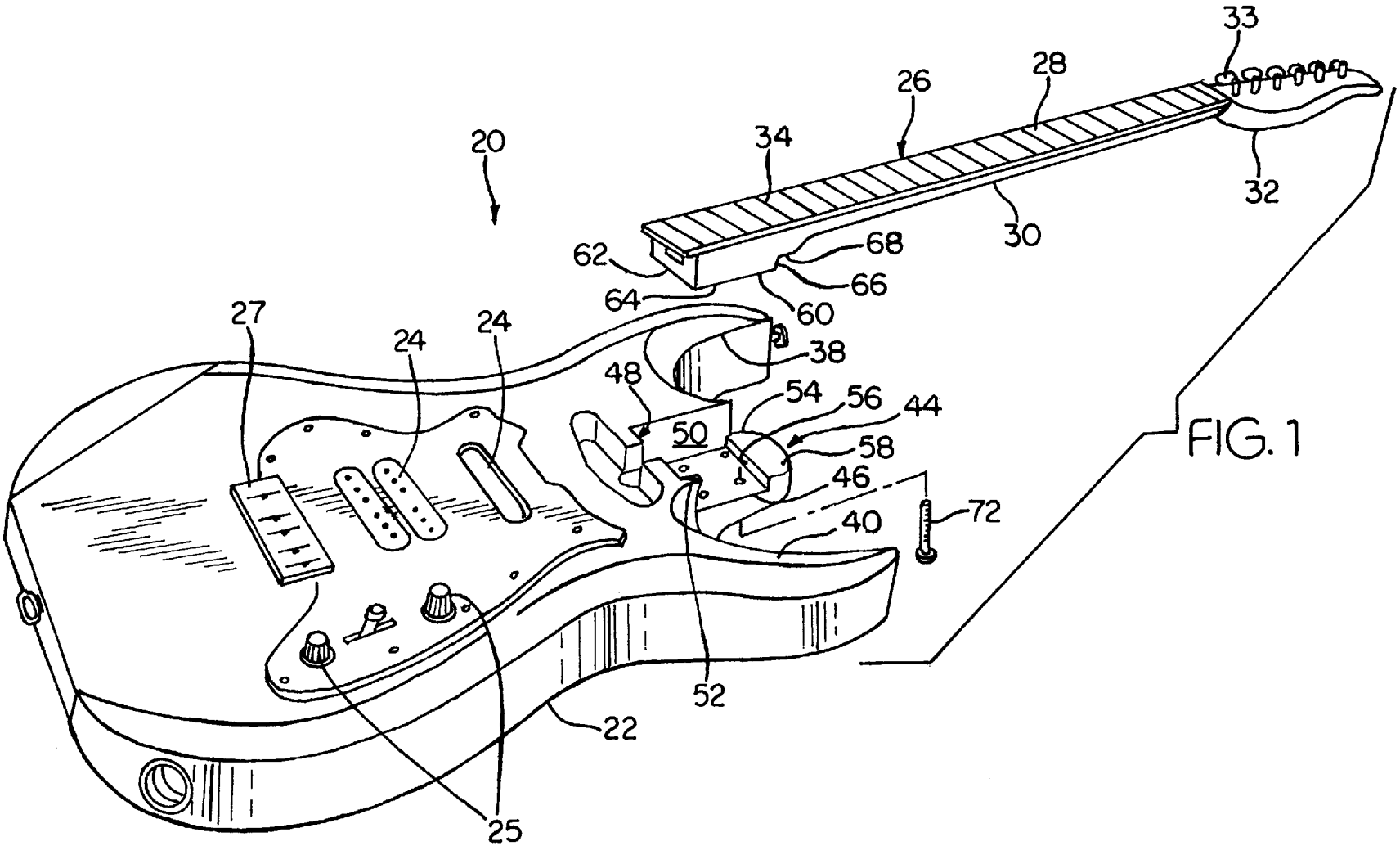
FIG. 1 is an exploded perspective view of the body and neck assemblies of the solid body electric guitar of this invention.

Referring more particularly to FIGS. 1–6, wherein like numbers refer to similar parts, an electric guitar 20 of the present invention is shown in FIG. 1. The guitar 20, shown with strings removed and in exploded view in FIG. 1, has a contoured wooden body 22 in which a number of cavities are formed to receive such elements of hardware as the guitar pickups 24, tone and volume control knobs 25, bridge 27, vibrato unit, etc. The neck 26 is a separable wooden element, commonly composed of two wooden components: a fingerboard 28 and a neck back 30. The neck back 30 includes the headstock 32 to which the tuning machine heads 33 are mounted. The fingerboard 28 may be of a different species of wood than the neck back 30, and has a number of frets 34 positioned to protrude above the fingerboard surface and spaced at precise distances along the fingerboard to make possible the sounding of the notes of a musical scale. Metal strings (not shown) extend from the machine heads 33 to the bridge 27. The strings 36 are brought into tune by applying tension to them by adjustment of the machine heads 33.

Because a guitar is played by depressing the strings 36 below particular frets 34, it is essential that the strings remain aligned over the fingerboard 28 as they extend from the machine heads 33 to the bridge 27. Any tendency for the neck 26 to shift or pivot with respect to the body 22 will tend to shift the strings off the fingerboard, and thereby hamper the playability of the instrument. Also the shifting changes the placement of the frets relative to the bridge which changes intonation and tuning. The guitar 20 of this invention has interlocking structure formed on the neck 26 and the body 22 which resist shifting of the neck 26 while still permitting ready disassembly of the neck from the body for adjustments, service and repair.

Figure 2:
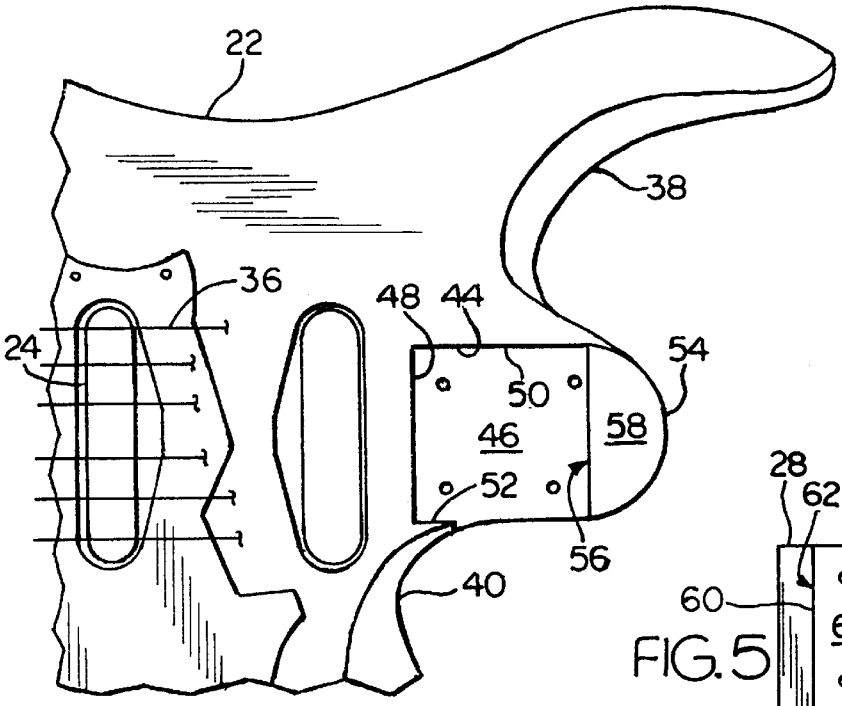
FIG. 2 is a fragmentary top plan view of the body of FIG. 1 showing the region where the neck attaches to the body.
Figure 5:
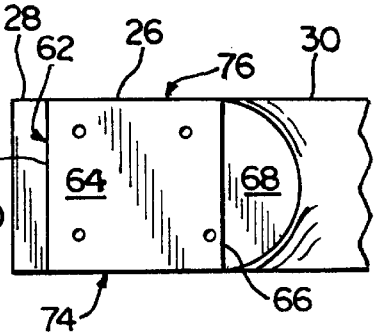
FIG. 5 is a fragmentary view of the neck of FIG. 3 taken along line 5—5.
Figure 3:
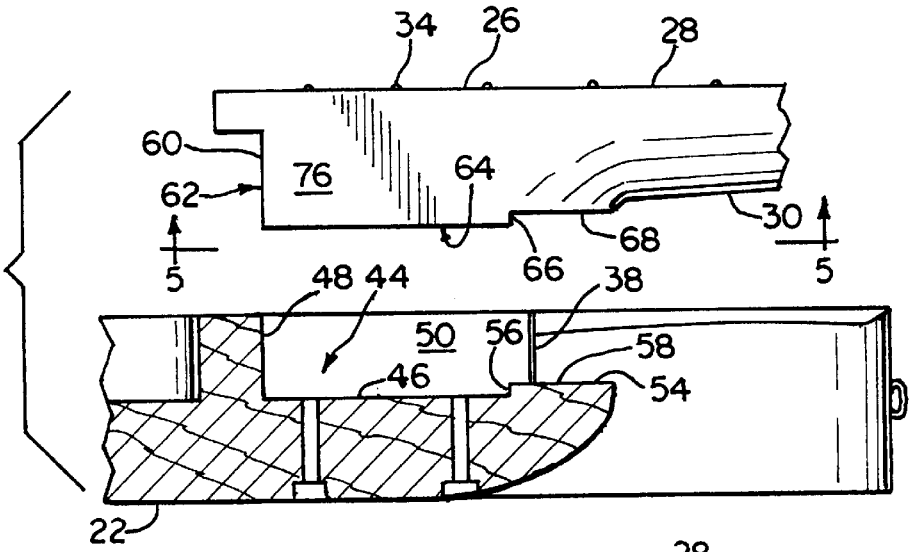
FIG. 3 is a fragmentary cross-sectional view of the body of FIG. 2, with the neck exploded above the body.
Figure 4:
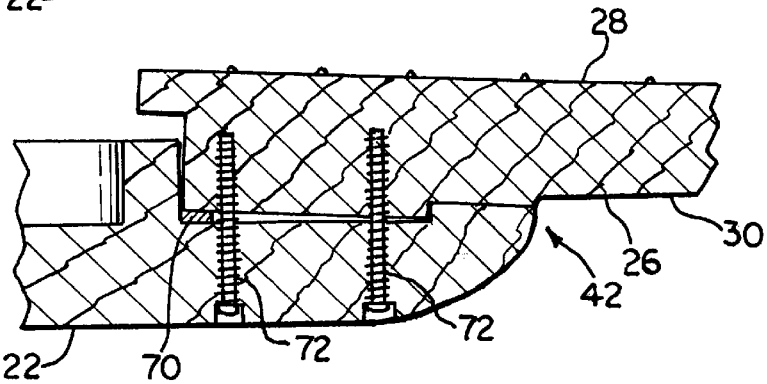
FIG. 4 is a fragmentary cross-sectional view of the assembled neck and body joint of the guitar of FIG. 1.

The guitar body 22 has a shallow cut-away 38 on the low-E string side of the fingerboard 28, and a deep cut-away 40 on the high-E string side of the fingerboard. The deep cut-away 40 is a conventional feature of solid body electric guitars which permits the player to access the frets on the neck which sound the highest pitch tones of the instrument. A neck-body joint 42 is defined where the neck 26 is connected to the body 22. The body 22 has a neck-receiving pocket 44 positioned between the shallow cut-away 38 and the deep cut-away 40 which is approximately half the depth of the body. As shown in FIGS. 2 and 3, the pocket has a planar floor 46 from which a pocket end wall 48 extends generally vertically on the body side of the pocket. A shallow cut-away side wall 50 extends upwardly from the pocket floor 46 on one side of the pocket 44, and a deep cut-away side wall 52 extends upwardly from the floor on the other side of the pocket. While the shallow cut-away side wall 50 may be several inches long, the opposite side wall 52, because of the adjoining deep cut-away, will generally be less than an inch long. The side walls 50, 52 are both perpendicular to the pocket floor 46, however they are preferably not parallel, but diverge from one another as they extend away from the neck 26 such that the volume defined within the pocket 44 is generally trapezoidal. The divergence of the side walls may be fairly small, on the order of one sixteenth of an inch or less.

Whereas the conventional guitar body has a neck receiving pocket with a base comprised of an unbroken floor, the body 22 of this invention has a restraint lip 54 which protrudes upwardly above the level of the pocket floor 46 at a position spaced from the pocket end wall 48. The lip 54 has a restraint wall 56 which is perpendicular to the floor 46 and which faces the pocket end wall 48. The lip 54 also has an upper abutment surface 58 which extends from the restraint wall 56 and which is generally parallel to the pocket floor 46.

Figure 6:
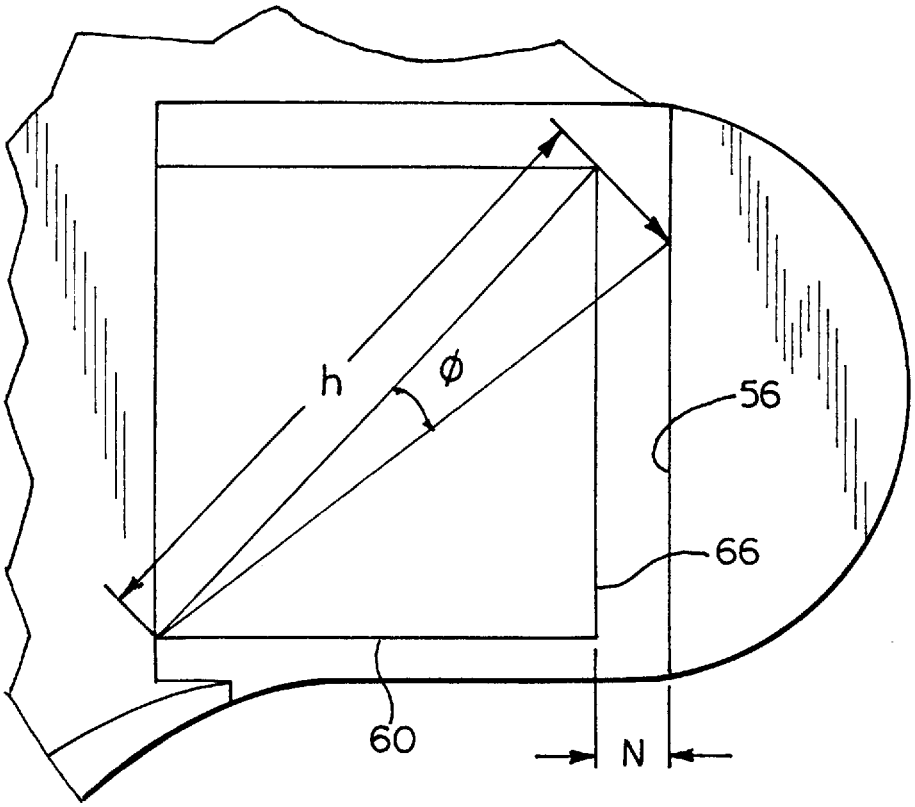
FIG. 6 is a schematic view illustrating the possible tilting of the neck of the instrument of FIG. 1 for a given amount of error in the size of the neck heel with respect to the pocket.

The neck 26 has mating structure which engages within the pocket 44. A generally trapezoidal heel 60 protrudes into the pocket from the neck back 30. The heel 60 has an end wall 62 which engages with the pocket end wall 48, and a bottom wall 64 which extends from the heel end wall 62 and which engages against the pocket floor 46. A heel restraint wall 66 extends from the heel bottom wall 64 and engages with the lip restraint wall 56. A heel abutment surface 68 extends away from the restraint wall 66. The heel abutment surface 68 may be spaced from the lip abutment surface 58, although the surfaces may contact if the neck is tipped backward by a sufficiently large wedge-shaped shim 70, as shown in FIG. 6.

The heel has a first side wall 74 which is parallel to the pocket side wall 50 and a second side wall which is parallel to the pocket side wall 52. To further restrain the neck from separation in the direction of the headstock 32 from the body, the heel first wall 74 diverges from the heel second wall 76.

It will be observed that by the engagement between the restraint lip 54 and the heel 60, the shifting or pivoting of the neck 26 with respect to the body 22 may be limited at any desired level by setting the tolerances in the manufacture of the body pocket and the neck heel. The neck 26 is also prevented from moving toward or away from the body 22 by being captured between the lip restraint wall 56 and the body pocket end wall 48. Mechanical fasteners such as screws 72 extend from the back of the body into the pocket 44 through the floor 46 and into the heel 60. The screws 72 prevent the lifting out of the neck from the body 22. Yet although the neck 26 is positively captured by the neck and body structure, it is easily removed when necessary by removal of the screws 72. Furthermore, the inclination of the neck may still be easily adjusted by the insertion of a shim 70, allowing for adjustment of string height above the fingerboard 28.

Furthermore, this structure is particularly adapted to the production of individually fitted necks and bodies in a quantity production setting. The closeness of the fit between the heel 60 and the neck-receiving pocket 46 can be controlled by removing more or less material from a single, easily accessible surface of the neck 26. By trimming the heel restraint wall 66, in a simple operation each production neck can be fitted precisely to the body. The heel restraint wall is open at each end to the sides of the neck, and therefore it may be easily accessed for trimming.

In addition, the neck-body joint 42 of this guitar 20 takes maximum advantage of the geometry offered by the instrument to minimize the amount of pivoting of the neck 26 for any given degree of tolerance between the restraint wall 66 on the neck heel 60 and the retraint wall 56 of the body lip 54. The distance between the pocket end wall 48 and the body restraint wall 56 is as large as the structure of the instrument allows. Hence, for any given degree of error in the size of the heel 60, the amount of tilt which can result is minimized. How far down into the body the pocket end wall 48 can be positioned is limited by the position of the pickups. How far up the neck 26 the heel 60 can extend is limited by the need to have a narrow neck to allow the player's fingers fit easily around the neck to reach the higher frets. This relationship is illustrated in FIG. 6, in which the error or tolerance N is shown greatly exaggerated for illustrative purposes. The maximum angle of tilt or pivot for the heel 60 and hence the neck 26 is the angle $\phi$. The angle $\phi$ for a given N is a function of the measure between corners h of the heel 60. It will be observed that for a shorter h, the angle $\phi$ will be larger. Hence, the tilt for a given tolerance will be greater when the corner to corner measure of the heel 60 is reduced.

It should be noted that although the body-neck joint of this invention has been illustrated on a double-cutaway type solid body electric guitar, it may also be employed on other body styles. In addition, this joint of this invention could be used in acoustic, and semi-acoustic guitars. It should be understood furthermore, that the term "guitar" as used herein, encompasses both guitars and basses.

It is understood that the invention is not limited to the particular construction and arrangement of parts herein illustrated and described, but embraces such modified forms thereof as come within the scope of the following claims.

I claim:

1. A guitar comprising:

a body having a bridge end and a neck end, and portions of the body define a neck-receiving pocket at the body neck end, the pocket having a substantially planar floor and a first side wall which extends upwardly from the pocket floor on one side of the pocket;

portions of the body which define a fixed restraint lip which protrudes upwardly above the level of the pocket floor at a position adjacent the body neck end, a first volume for receipt of a neck protrusion being defined between the restraint lip, and the pocket first side wall, the lip having a restraint wall which is substantially perpendicular to the floor and which faces the bridge end of the body;

neck which extends away from the body and which supports a fingerboard thereon, the neck having portions defining a protruding heel which extends into the first volume, wherein the heel extends between an end wall which faces towards the bridge end, and a restraint wall which faces away from the bridge end of the body, the heel restraint wall engaging against the pocket restraint wall, and the heel having a bottom wall which extends from the heel restraint wall and which engages against the pocket floor; and fasteners which removably connect the neck to the body, wherein a heel abutment surface extends away from the neck heel restraint wall, and an abutment surface is defined on the body restraint lip extending from the restraint wall, and further comprising a wedge-shaped shim disposed between the neck heel and the pocket floor, to thereby incline the neck such that the heel abutment surface engages the body restraint lip abutment surface.

2. A guitar comprising:

a body having a bridge end and a neck end, and portions of the body define a neck-receiving pocket at the body neck end, the pocket having a substantially planar floor and a first side wall which extends upwardly from the pocket floor on one side of the pocket;

portions of the body which define a fixed restraint lip which protrudes upwardly above the level of the pocket floor at a position adjacent the body neck end, a first volume for receipt of a neck protrusion being defined between the restraint lip, and the pocket first side wall, the lip having a restraint wall which is substantially perpendicular to the floor and which faces the bridge end of the body;

a neck which extends away from the body and which supports a fingerboard thereon, the neck having portions defining a protruding heel which extends into the first volume, wherein the heel extends between an end wall which faces towards the bridge end, and a restraint wall which faces away from the bridge end of the body, the heel restraint wall engaging against the pocket restraint wall, and the heel having a bottom wall which extends from the heel restraint wall and which engages against the pocket floor; and fasteners which removably connect the neck to the body, wherein the neck-receiving pocket is positioned between portions of the body which define a shallow cutaway and a deep cut-away.

3. A guitar comprising:

a body having a bridge end and a neck end, and portions of the body define a neck-receiving pocket at the body neck end, the pocket having a substantially planar floor and a first side wall which extends upwardly from the pocket floor on one side of the pocket;

portions of the body which define a fixed restraint lip which protrudes upwardly above the level of the pocket floor at a position adjacent the body neck end, a first volume for receipt of a neck protrusion being defined between the restraint lip, and the pocket first side wall, the lip having a restraint wall which is substantially perpendicular to the floor and which faces the bridge end of the body;

a neck which extends away from the body and which supports a fingerboard thereon, the neck having portions defining a protruding heel which extends into the first volume, wherein the heel extends between an end wall which faces towards the bridge end, and a restraint wall which faces away from the bridge end of the body, the heel restraint wall engaging against the pocket restraint wall, and the heel having a bottom wall which extends from the heel restraint wall and which engages against the pocket floor; and fasteners which removably connect the neck to the body, wherein the pocket first side wall is perpendicular to the pocket floor, and portions of the body define a pocket second side wall which is perpendicular to the pocket floor, and wherein the pocket second side wall is spaced sidewardly from the pocket first wall, and wherein the pocket first side wall diverges from the pocket second side wall as the two walls extend toward the bridge end such that the volume defined within the pocket is generally trapezoidal.

4. The guitar of claim 3 wherein the heel has a first wall which is parallel to the pocket first wall, and the heel has a second wall which is parallel to the pocket second wall.

5. The guitar of claim 4 wherein the heel first wall diverges from the heel second wall as the heel extends toward the body pocket end wall.

6. A guitar comprising:

a body having portions defining a neck-receiving pocket, the pocket having a planar floor from which a pocket end wall extends generally vertically on a body side of the pocket, the pocket end wall extending to a front surface of the body, and a first side wall extends upwardly from the pocket floor on one side of the pocket, and a second side wall extends upwardly from the floor on the other side of the pocket, portions of the body which define a fixed restraint lip which protrudes upwardly above the level of the pocket floor at a position spaced from the pocket end wall; the lip having a restraint wall which is perpendicular to the floor and which faces the pocket end wall, wherein the pocket floor extends from the restraint wall to the pocket end wall and is generally planar, and wherein the lip has an upper abutment surface which extends from the restraint wall and which is generally parallel to the pocket floor;

a neck which extends away from the body and which supports a fingerboard, the neck having portions defining a protruding heel which extends into the body neck-receiving pocket, wherein the heel has an end wall which engages with the pocket end wall, and a bottom wall which extends from the heel end wall and which engages against the pocket floor, and wherein a heel restraint wall extends from the heel bottom wall and engages with the lip restraint wall; and fasteners which extend between the body and the neck to releasably connect the neck to the body, wherein the neck-receiving pocket is positioned between portions of the body which define a shallow cut-away and a deep cut-away.

7. A guitar comprising:

a body having portions defining a neck-receiving pocket, the pocket having a planar floor from which a pocket end wall extends generally vertically on a body side of the pocket, the pocket end wall extending to a front surface of the body, and a first side wall extends upwardly from the pocket floor on one side of the pocket, and a second side wall extends upwardly from the floor on the other side of the pocket, portions of the body which define a fixed restraint lip which protrudes upwardly above the level of the pocket floor at a position spaced from the pocket end wall; the lip having a restraint wall which is perpendicular to the floor and which faces the pocket end wall, wherein the pocket floor extends from the restraint wall to the pocket end wall and is generally planar, and wherein the lip has an upper abutment surface which extends from the restraint wall and which is generally parallel to the pocket floor;

a neck which extends away from the body and which supports a fingerboard, the neck having portions defining a protruding heel which extends into the body neck-receiving pocket, wherein the heel has an end wall which engages with the pocket end wall, and a bottom wall which extends from the heel end wall and which engages against the pocket floor, and wherein a heel restraint wall extends from the heel bottom wall and engages with the lip restraint wall; and fasteners which extend between the body and the neck to releasably connect the neck to the body, wherein the pocket first side wall and the pocket second side wall are both perpendicular to the pocket floor and wherein the pocket first side wall diverges from the pocket second side wall as the two walls extend away from the neck, such that the volume defined within the pocket is generally trapezoidal.

8. The guitar of claim 7 wherein the divergence of the side walls is approximately one sixteenth of an inch or less.

9. The guitar of claim 7 wherein the heel is generally trapezoidal.

10. The guitar of claim 7 wherein the heel has a first wall which is parallel to the pocket first wall, and the heel has a second wall which is parallel to the pocket second wall.

11. The guitar of claim 10 wherein the heel first wall diverges from the heel second wall as the heel extends toward the body pocket end wall.

12. A guitar comprising:

a body having portions defining a neck-receiving pocket, the pocket having a planar floor from which a pocket end wall extends generally vertically on a body side of the pocket, the pocket end wall extending to a front surface of the body, and a first side wall extends upwardly from the pocket floor on one side of the pocket, and a second side wall extends upwardly from the floor on the other side of the pocket, portions of the body which define a fixed restraint lip which protrudes upwardly above the level of the pocket floor at a position spaced from the pocket end wall; the lip having a restraint wall which is perpendicular to the floor and which faces the pocket end wall, wherein the pocket floor extends from the restraint wall to the pocket end wall and is generally planar, and wherein the lip has an upper abutment surface which extends from the restraint wall and which is generally parallel to the pocket floor;

a neck which extends away from the body and which supports a fingerboard, the neck having portions defining a protruding heel which extends into the body neck-receiving pocket, wherein the heel has an end wall which engages with the pocket end wall, and a bottom wall which extends from the heel end wall and which engages against the pocket floor, and wherein a heel restraint wall extends from the heel bottom wall and engages with the lip restraint wall; and fasteners which extend between the body and the neck to releasably connect the neck to the body, wherein a heel abutment surface extends away from the neck heel restraint wall, and further comprising a wedge-shaped shim disposed between the neck heel and the pocket floor, to thereby incline the neck such that the heel abutment surface engages the body restraint lip abutment surface.

13. A guitar of the type having a body with portions defining a neck-receiving pocket, the pocket having a planar floor from which a pocket end wall extends generally vertically on a body side of the pocket, and a first side wall extends upwardly from the pocket floor on one side of the pocket, and a second side wall extends upwardly from the floor on the other side of the pocket, and a wooden neck releasably fastened to the body within the neck-receiving pocket, the improvement comprising:

portions of the body which define a restraint lip which protrudes upwardly above the level of the pocket floor at a position spaced from the pocket end wall, the lip having a restraint wall which is perpendicular to the floor and which faces the pocket end wall; and portions of the the neck defining a protruding heel which extends into the body neck-receiving pocket, wherein the heel has an end wall which extends adjacent the pocket end wall, and a bottom wall which extends from the heel end wall and which engages against the pocket floor, and wherein a heel restraint wall extends approximately perpendicularly to the heel bottom wall and engages with the lip restraint wall to restrict side-to-side shifting and tilting of the neck with respect to the body, the heel restraint wall terminating at opposite sides of the neck and is open so that it may be easily accessed for modification thereof.

14. The solid body electric guitar of claim 13 wherein the lip has an upper abutment surface which extends from the lip restraint wall and which is generally parallel to the pocket floor, and wherein the heel has an abutment surface which extends from the heel restraint wall and extends parallel to and adjacent the lip abutment surface.

15. A guitar of the type having a body joined to a neck which terminates in a head stock and has strings which define a plane, the string being stretched between the head stock and the body; the improvement comprising:

a joint structure between the neck and the body which provides bending stiffness between the neck and the body in a direction defined by the loads produced by the strings and also provides stiffness in a direction perpendicular to and parallel to the plane of the strings, wherein the body has a pocket for receiving a portion of the neck therein, the pocket having a pocket end wall which extends substantially transverse to the direction defined by the loads produced by the strings and perpendicular to the plane defined by the strings, the pocket having a substantially planar floor parallel to the plane defined by the strings which extends towards the head stock, the planar floor terminating at a lip substantially parallel to the pocket end wall which extends upwardly from the planar floor substantially less than the perpendicular height of the end wall, the lip joining an abutment surface of the lip parallel to the planar floor and extending towards the head stock until it reaches an edge of the body;

the neck having a heel end wall surface and a restraint wall surface in spaced parallel relation, the heel end wall surface and the restraint wall surface being joined by a planar bottom wall which is substantially perpendicular to the heel end wall surface and the restraint wall surface, and an abutment surface of the neck extends parallel to the bottom wall and extends towards the head stock from the restraint wall surface, wherein the heel end wall surface closely abuts the pocket end wall and substantially covers the pocket end wall, the restraining wall closely abutting the restraining wall, and the heel bottom wall overlying and engaging the pocket planar floor, and wherein the abutment surface of the neck overlies and engages the abutment surface of the lip; and at least two fasteners joining the neck to the body.

* * * * *